US006763978B2

(12) United States Patent
Pritchett et al.

(10) Patent No.: US 6,763,978 B2
(45) Date of Patent: Jul. 20, 2004

(54) DISPENSER PUMPS

(75) Inventors: David John Pritchett, West Hallam (GB); Brian Robert Law, Leicester (GB); Jeffrey William Spencer, Kirby Muxloc (GB)

(73) Assignee: Rieke Packaging Systems Limited, Leicestershire (GB)

( * ) Notice: Subject to any disclaimer, the term of this patent is extended or adjusted under 35 U.S.C. 154(b) by 0 days.

(21) Appl. No.: 10/433,491

(22) PCT Filed: Nov. 30, 2001

(86) PCT No.: PCT/GB01/05326

§ 371 (c)(1),
(2), (4) Date: Nov. 10, 2003

(87) PCT Pub. No.: WO02/43875

PCT Pub. Date: Jun. 6, 2002

(65) Prior Publication Data

US 2004/0065689 A1 Apr. 8, 2004

(30) Foreign Application Priority Data

Dec. 1, 2000 (GB) ..... 0029369

(51) Int. Cl.[7] ..... B65D 88/54

(52) U.S. Cl. ..... 222/321.7; 222/380; 222/383.1; 222/387

(58) Field of Search ..... 222/321.7, 321.9, 222/321.1, 321.8, 385, 380, 383.1, 387, 207, 209, 561, 562, 340, 341, 257–260

(56) References Cited

U.S. PATENT DOCUMENTS

| | | | | | |
|---|---|---|---|---|---|
| 4,657,161 | A | * | 4/1987 | Endo et al. | 222/256 |
| 4,679,712 | A | * | 7/1987 | Foster et al. | 222/384 |
| 4,776,496 | A | * | 10/1988 | Battegazzore | 222/209 |
| 4,830,228 | A | * | 5/1989 | Fillmore | 222/209 |
| 4,890,773 | A | * | 1/1990 | Corsette | 222/380 |
| 5,271,534 | A | * | 12/1993 | Fillmore et al. | 222/380 |
| 6,460,739 | B1 | * | 10/2002 | Norris et al. | 222/380 |

* cited by examiner

*Primary Examiner*—Frederick C. Nicolas
(74) *Attorney, Agent, or Firm*—Fay, Sharpe, Fagan, Minnich & McKee, LLP

(57) ABSTRACT

A dispenser pump e.g. for toothpaste has a plunger (21) connected to a proximal end of an elongate flexible plastics strip (22) which is run slidably along a guide track built into the discharge nozzle (14) of the pump alongside the discharge channel (63). The distal end of the guide track defines a bend which opens through a lateral slot into the discharge channel (63) just inside its external opening. Action of the plunger causes the strip (22) to slide back and forth along the track and round the bend, so that the tip of the strip is moved out of the mouth of the nozzle during dispensing but returns to block it and cut away residual product when the plunger is released.

9 Claims, 5 Drawing Sheets

Fig. 2
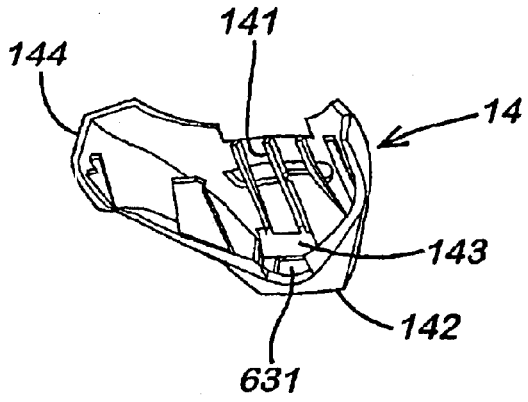
Fig. 3
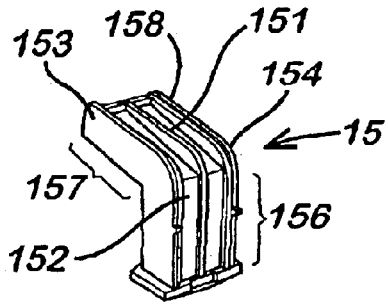
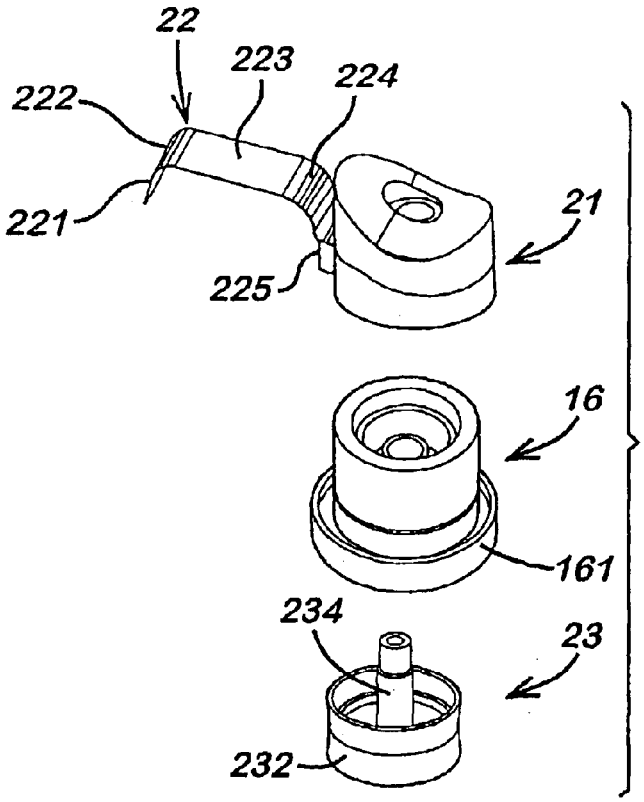
Fig. 4

DISPENSER PUMPS

FIELD OF THE INVENTION

This invention has to do with dispenser pumps for dispensing discrete doses of a flowable material from a container on which the pump is fitted. The present proposals have particular relevance to dispenser pumps for use with viscous or pasty materials. They are also relevant when material to be dispensed needs to be protected from contact with air e.g. to prevent drying out or degradation. We particularly envisage that the invention may be embodied in a toothpaste dispenser.

BACKGROUND

In recent years toothpaste dispensers have become widely available in which a relatively large volume of paste is contained in a free standing container, and a piston-and-cylinder dispenser pump with a fixed discharge nozzle is provided at the top of the container to dispense a dose of toothpaste when the pump piston is depressed. Known pumps include arrangements for covering, blocking or shielding the discharge nozzle outlet between operations of the pump to keep the residual paste in the pump from drying out and to help separate the tail end of each dispensed dose from the nozzle tip. Toothpaste is extremely sticky and there are often problems in that slugs of paste issuing forth are not cleanly cut off, leading to toothpaste being smeared over the outside of the nozzle tip by the cover arrangement which is precisely the opposite of what is wanted.

THE INVENTION

The aim here is to propose new and useful dispenser pumps including a novel arrangement for blocking a discharge nozzle of the pump. A particular aim is to provide a pump which is for use with materials of the kinds mentioned above e.g. toothpaste.

In general terms, a dispenser pump of the relevant kind has a pump chamber whose volume is alterable in a pumping stroke by relative movement between a body of the pump and a plunger which is reciprocable relative to the body by hand actuation. Typically the plunger has a piston which works in a cylinder of the pump body, the piston and cylinder defining a pump chamber between them. An inlet is provided for flowable material to enter the pump chamber from a container to which the pump is secured, and an outlet of the pump chamber leads to a discharge passage which extends along a discharge nozzle to an external nozzle opening. Usually a one-way inlet valve is necessary and a one-way discharge valve is preferred.

A blocking element is provided, dimensioned to close off the discharge passage and arranged for guided movement transverse to the discharge passage between blocked and open positions. Preferably the blocking element traverses the discharge passage at a blocking location which is at or adjacent the external nozzle opening. The discharge nozzle construction includes a guide track leading around a bend to the blocking location. Preferably this bend or angle is substantially in longitudinal register with the blocking location. An elongate drive connector extends along this guide track, and is longitudinally slidable relative to it. This connector has a proximal part connected to the pump plunger, so that operation of the pump by moving the plunger relative to the pump body drives longitudinal movement of the drive connector along the guide track. A distal portion of the drive connector acts on the blocking element, preferably by being joined to or integral with it. The drive connector is also flexible, so as to be able to negotiate the bend in the guide track. By these means, operation of the pump by moving the plunger relative to the body drives movement of the blocking element across the discharge passage between the blocked and open positions.

By having the distal part of the drive connector joined to or integral with the blocking element, it can both push and pull the blocking element. Correspondingly, it is preferred that the proximal part of the drive connector is connected to the pump plunger in such a way that the two directions of plunger movement positively drive respectively the opening and closing of the discharge passage. The drive connector may include one or more non-flexing parts which do not pass around a bend and are thickened or reinforced relative to the flexing part(s), helping to avoid buckling under longitudinal compression.

The guide track preferably has a portion which extends alongside the discharge passage, leading around a distal bend to a transverse portion adjacent the blocking location. Guide track engagement at the outside of the bend, preferably by one or more curved elements, enables transverse action of the blocking element by pushing. Guide track engagement on the inside of the bend enables transverse action of the blocking element by pulling. Preferably both are present.

In preferred pumps the discharge nozzle extends generally transversely to the direction of the plunger action. In this situation the guide track may have a proximal corner which is between a longitudinal portion extending along the discharge nozzle and a proximal portion extending in the plunger's direction of action. Again, guide track engagements to the inside and outside of such a corner enable pulling and pushing actions of the connector respectively and are preferably combined.

By these means, plunger movement in one direction may drive movement of the blocking element relative to the transversally-extending discharge passage in substantially the opposite direction.

Even when the discharge nozzle and plunger action are mutually transverse, it is possible to avoid the need for the drive connector to flex around more than one corner. This may be desirable because it reduces the longitudinal extent of the connector required to be flexible, and therefore reduces any tendency for it to buckle under compression. A way of achieving this is by having a coupling between the plunger action and the drive connector proximal end which is pivoted around an axis perpendicular to the plunger axis and to the guide track, the coupling and the proximal end of the drive connector being joined (preferably flexibly) at a joint substantially at a tangent point of the drive connector with respect to the coupling's pivot axis. Such a coupling may for example be comprised in a pivoted actuating lever for the dispenser pump which acts on both the pump plunger stem and the drive connector for the blocking element.

A preferred disposition of the pump for these purposes, as indeed for the others, has the pump arranged with its plunger axis generally upright at the back of the dispenser, the discharge passage extending from the outlet at the bottom of the pump, up in front of the pump and then forwardly along the discharge nozzle to the discharge opening. The discharge nozzle is preferably at substantially the same height at the actuating portion at the top of the pump plunger.

A preferred form of the flexible elongate drive connector is a strip or tongue form, since this flexes more readily in one sense than in the perpendicular sense, facilitating guiding. It is generally convenient to arrange all guide track bends to be in one plane. A strip-form connector is also easy to form in plastics material. It may be formed as an integral projection on one of the pump components e.g. a plunger part. Furthermore the blocking element may itself be an integral continuation of the drive connector, e.g. an end thereof.

A blocking element which is a continuation of a flexible connector strip may itself pass around a corner of the guide track adjacent the blocking location, reducing the transverse dimension required for the nozzle. The blocking element may therefore also be flexible.

For a strip-form connector the guide track is preferably an elongate slot. A suitable track may be formed between complementarily-shaped opposed surfaces of two discharge nozzle components.

Means may be provided for reducing friction along the guide track. One or both components, preferably at least the connector, may be made from low-friction material or provided with a friction-reducing coating. A guide track for a strip-form connector can have one or more localised surface projections e.g. ribs to engage the connector with reduced contact area.

A preferred refinement of the pump assures at least partial opening of the discharge passage before the pump pressurizes the material in it. This is achievable by connecting the drive connector to an actuating part of the pump plunger such as a button or lever, and providing some lost motion in the connection between the actuating part and a piston part, so that driving of the piston begins only after some movement of the blocking element away from the blocked position.

As suggested above, a preferred embodiment of the invention is a toothpaste dispenser in which the dispenser is mounted at the top of a container for toothpaste adapted for airless dispensing e.g. by a container base in the form of a follower piston which rises up the container as material is dispensed, or by means of a flexible container or flexible container liner which gradually collapses as material is dispensed.

Combining various preferred features disclosed above, a preferred dispenser pump of such a toothpaste dispenser is as follows. The fixed pump body incorporates a fixed discharge nozzle projecting laterally. The pump plunger carries a piston operable in a cylinder of the pump body, with the plunger axis generally upright. The pump chamber inlet is into the bottom of the cylinder through a pump body base spanning the top of the container. The pump chamber outlet opens downwardly from the pump chamber e.g. into a annular discharge space leading to an initial riser portion of the discharge passage alongside the pump cylinder and them round an angle into a transverse portion of the discharge passage in the projecting discharge nozzle. The discharge nozzle includes inner and outer nozzle parts which fit together to define between them a guide track extending along the discharge nozzle and round a distal bend adjacent its end to open transversely onto the discharge passage adjacent its exterior opening.

In one version the inner end of the guide track bends inwardly and down around the angle between the first and second parts of the discharge passage, and accesses the side of the moveable plunger. A flexible strip is attached to the side of the plunger—e.g. formed integrally with it—and extends along the guide track up around the inside bend, along the nozzle and down out of the guide track's distal opening to act across the discharge passage.

In another version a pivoted coupling is provided, connected to both the flexible strip and the pump plunger so that no inside bend of the strip is required.

The end of the strip fully blocks the discharge passage in the raised position of the plunger; its end edge may then seat in a recess on an opposing lower side of the discharge passage. Depression of the plunger pulls the strip along the guide track, flexing as it passes round the bend(s) and drawing the end blocking portion up out of the discharge passage and at least partially into the distal bend of the guide track. On release the plunger rises under the force of a restoring spring, pushing the flexible strip back along the guide track and its tip back across the discharge passage adjacent the nozzle opening to close it off. The closeness of fit of the strip in the guide track can be selected, along with suitable thickness of the strip, to enable this pushing effect without kinking or crumpling of the strip.

Embodiments of these proposals are now described by way of example.

BRIEF DESCRIPTION OF THE DRAWINGS

FIG. 2 is a view from below and behind of a nozzle outer shell;

FIG. 3 is a view from above and behind of a nozzle core component;

FIG. 4 is an exploded view showing an operating button, a cylinder component and a piston element;

DETAILED DESCRIPTION OF PREFERRED EMBODIMENTS

Figure 1:
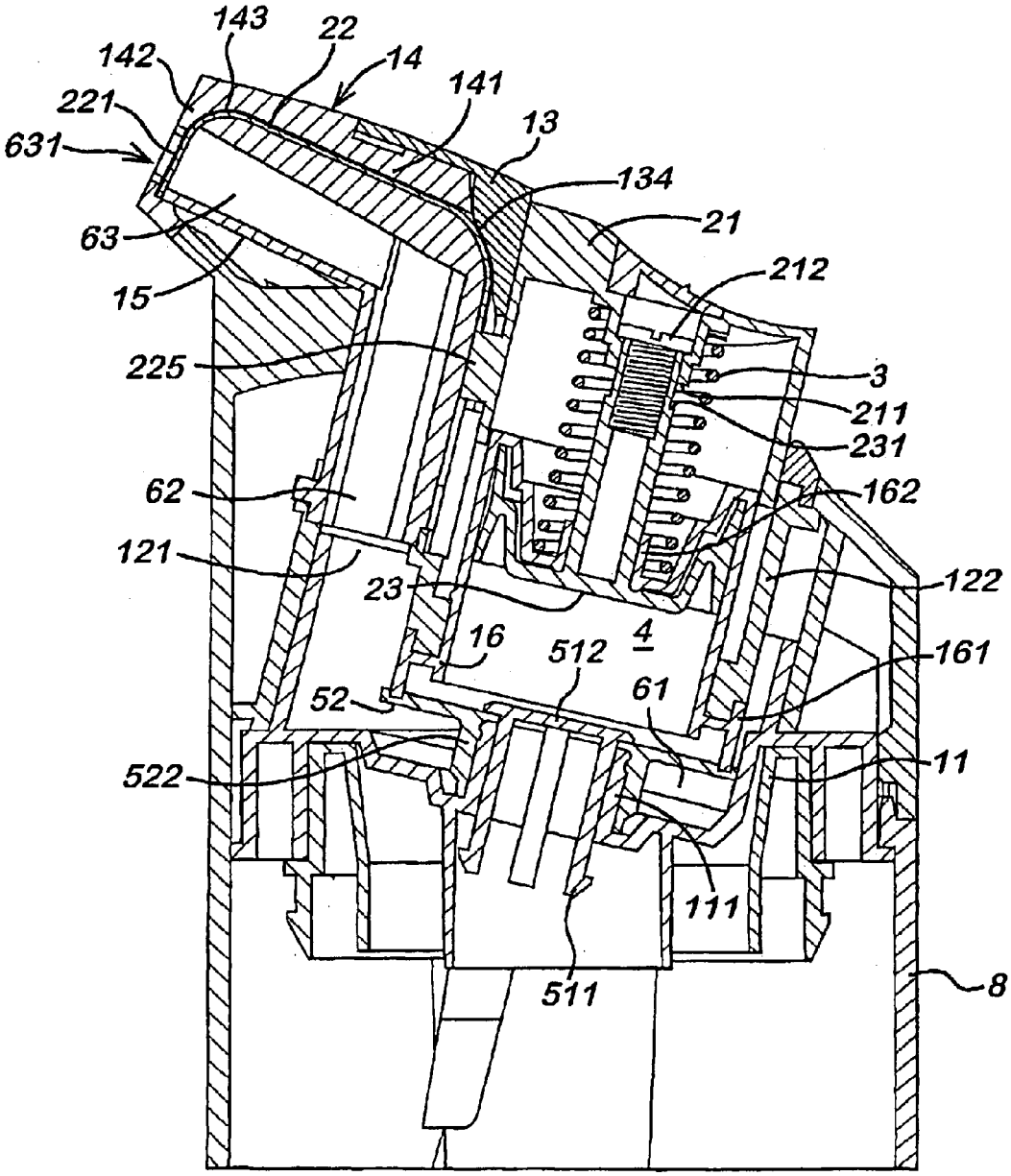
FIG. 1 is an axial sectional view of a toothpaste dispenser pump, showing also the top of a toothpaste container.
Figure 5:
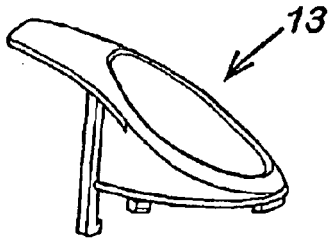
FIG. 5 is a side view of a body top insert.
Figure 6:
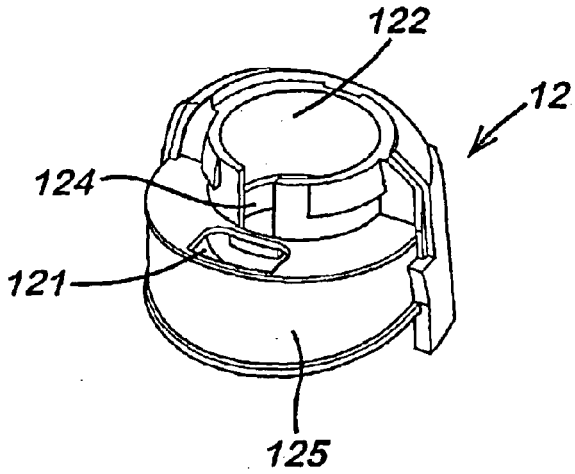
FIG. 6 is a view from above and in front of a main body shell.
Figure 7:
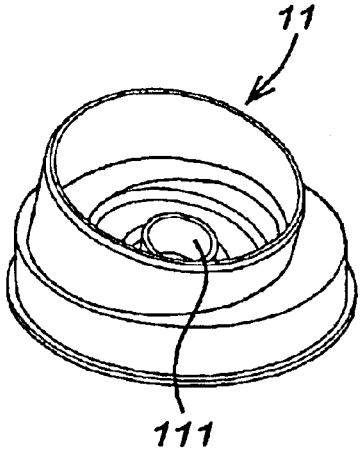
FIG. 7 is a view from above and one side of a body base.

A first embodiment of dispenser pump, designed for dispensing toothpaste, is shown in FIGS. 1–7. In terms of its structural components, the dispenser includes a toothpaste container 8 whose specific construction is of no particular relevance, a pump base 11 spanning the top of the toothpaste container 8 (and shown in FIG. 7), a pump body component 12 fitting onto the pump base 11 (seen in FIG. 6) and a cylinder 16, seen in the centre of FIG. 4, which is mounted in the pump body 12. A pump plunger and attached piston 21, 23,also seen in FIG. 4, operate along a generally upright axis in the cylinder 16. A discharge nozzle at the top front of the pump is provided by a discharge channel component 15 housed beneath a top nozzle shroud 14 (FIG. 2). A top insert 13 (FIG. 5) fits onto the top of the pump body 12 to hold the plunger components in place and guide their stroke.

Considering these components now in more detail, the pump body 12 includes a cylinder housing 122 with a forwardly-opening axis or tracking slot 124, and an annular chamber 125 forming a discharge space with an upwardly-directed discharge opening 121. The cylinder proper 16 fits coaxially into the cylinder housing 122, being held down in place by an annular flange 161 trapped below the cylinder housing.

The pump base 11 has an inlet opening 111 in which an inlet valve body, comprising a blocking disc 512 and sliding retaining legs 511, is fitted. Other kinds of inlet valves may be used if wished. An annular space 61 surrounds the projecting inlet conduit 111, and an annular elastomeric outlet valve 52 is fitted over this. This outlet valve has a lower cylindrical sleeve which clamps it down onto the inlet conduit 111, a central hole for the inlet opening, and a flat radial flap projection which bears resiliently against the bottom edge of the cylinder flange 161.

The plunger construction includes a plunger cap 21, a piston 23 and a flexible closure strip or tongue 22. See FIG. 1 and FIG. 4. The piston 23 has a conventional double-acting flexible seal 232 engaging the wall of the cylinder 16 to define a pump chamber for inside the cylinder, governed by the inlet and outlet valves described above. The stem 234 of the piston is joined to the underside of the plunger cap 21 with some axial lost motion by means of a securing bolt 212 which traps its top end in a tubular formation of the cap 21. The reduced-diameter top end of the stem is axially slidable to a limited extent in this formation of the cap, so that when the cap is depressed the piston initially does not move until a downwardly-directed shoulder 211 of the cap formation meets an upwardly-directed shoulder 231 of the stem. The reason for this is explained below.

A conventional steel pump spring 3 is trapped between the plunger cap and ah inward projection of the cylinder 16 so that the plunger is continually urged upwardly relative to the cylinder, and the plunger cap 21 and piston 23 are urged apart.

At the front of the pump the upward opening 121 of the annular discharge chamber 125 opens into the bottom end of the discharge channel component 15. This component is essentially a rectangular-section pipe with an upright leg 156 joined via a substantially right-angled bend to a longitudinal leg 157. It is supported from below by the pump body 12 and held in place from above by the nozzle shroud 14, which includes a front opening 631 registering with the front opening of the channel 15.

The upper and outer surface of the channel 15 complements the undersurface of the nozzle shroud 14 so that a guide track is defined between them. Specifically, longitudinal side flanges 158 of the channel 15 meet corresponding downward ribs of the shroud 14 to act as spacers. Opposed upward and downward central ribs 151, 141 on these components are then held at a substantially uniform slit spacing as seen in the section of FIG. 1. To either side of these ribs the shroud and channel surfaces are recessed away to reduce friction. Rearwardly of the nozzle shroud 14 the outer spacer ribs 158 and inner guide rib 151 of the channel 15 continue back down around the bend 154 and onto the riser leg 156. At the bend 154 they are opposed by corresponding spacer and guide formations on the top insert 13, not shown in detail but apparent from FIG. 1.

The flexible strip 22 is formed integrally on the front of the plunger cap 21. It is moulded in one piece with the cap, and takes the form of a blade or tongue of generally uniform width and thickness extending from a root block 225 at the front of the cap 21. This block 225 fits and is guided in the front track opening 124 of the pump body 12. The blocking strip 22 has an as-moulded conformation as shown in FIG. 4, generally matching the conformation of the guide track defined around the outer surface of the channel 15. Thus it has a proximal bend 224, a longitudinal straight portion 223, a distal bend 222 and an end portion 221 which also serves as a blocking portion. Alternatively it may be formed straight (i.e. parallel to the cap axis) which requires bending on installation but improves resistance to buckling under compression.

The strip/plunger cap components are moulded from polypropylene material incorporating anti-static and slip additives which give low frictional resistance to movement of the strip 22 along the guide track. The end, blocking portion 221 of the strip is dimensioned so that as seen in FIG. 1 it can extend right across the front opening of the channel 15 and finish in a guide slot at the opposite, lower side of the shroud opening 631. Its side edges also engage behind overlapping side guide portions of the shroud 14 adjacent to the opening 631 to guide its movement across the opening.

The operation of the pump is as follows. Its rest condition is as shown in FIG. 1. The user presses the plunger cap 21. The initial part of the stroke takes up the lost motion between the cap 21 and the piston stem 234, so the piston 23 does not move. However the root 225 of the blocking strip 22 starts to move down the slot 124 and starts to pull the strip 22 back along the guide track, with flexion as it passes around the inner and outer bends thereof, and withdrawing the end blocking part 221 of the strip from the nozzle's outer opening 631. Thus, when the opposed shoulders 211, 231 of the plunger cap 21 and piston stem 234 meet and the piston starts to move down, forcing toothpaste out from the pump chamber (via the outward valve 52, the riser of portion 62 of the discharge passage and the nozzle portion 63 of the discharge passage) the opening 631 is already at least partially unobstructed so that there is no undue pressure build-up.

The plunger stroke continues to the bottom, or as far as the user wishes in terms of the amount of toothpaste wanted, and is then released. The spring pushes the plunger cap 21 up again, carrying the root of the strip 22 up along the track 124 and pushing the strip 22 back along its guide track. The blocking end 221 of the strip—which was previously flexed around the corner above the discharge nozzle—is pushed back into position across the nozzle opening 631, cutting off the toothpaste cleanly. By having the blocking location closely adjacent to the nozzle opening 631, exposed residues are minimised. The anti-slip properties of the strip 22 then help prevent toothpaste from sticking. In alternative embodiments it may be arranged that the outer opening 631 of the shroud is substantially wider than the adjacent inner opening of the channel (although still making any necessary guiding engagements with the blocking element) to further reduce the surface available for toothpaste to stick to adjacent the opening after dispensing.

As the plunger rises the pump chamber is refilled in a conventional manner through the inlet valve.

The reader will note how the disposition of the bend and its corresponding guide portions 143,153 immediately adjacent the nozzle opening can minimise the increase in dimensions of the discharge nozzle caused by having the internal guide track running along it.

Depending on the specific materials and orientations of the pump components, it may in some cases be found that a rather large force is needed on the return stroke to push the flexible element 22 back around the bends, taking into account sufficient sturdiness of the flexible component to avoid buckling under compression. This means a stronger pump spring which may sometimes be undesirable.

Figure 8:
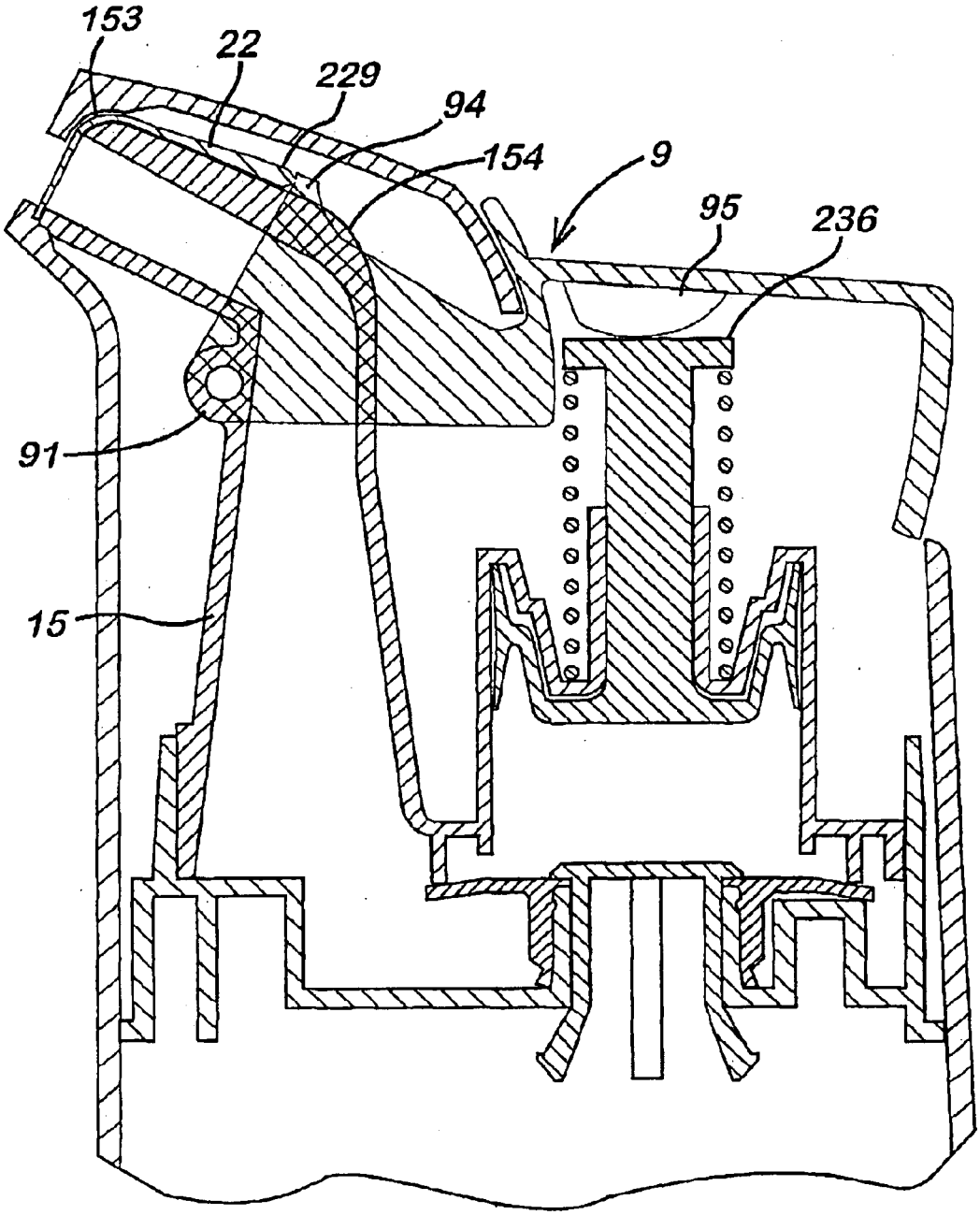
FIGS. 8 and 9 are axial sectional views of a second embodiment in rest and pressed conditions.
Figure 9:
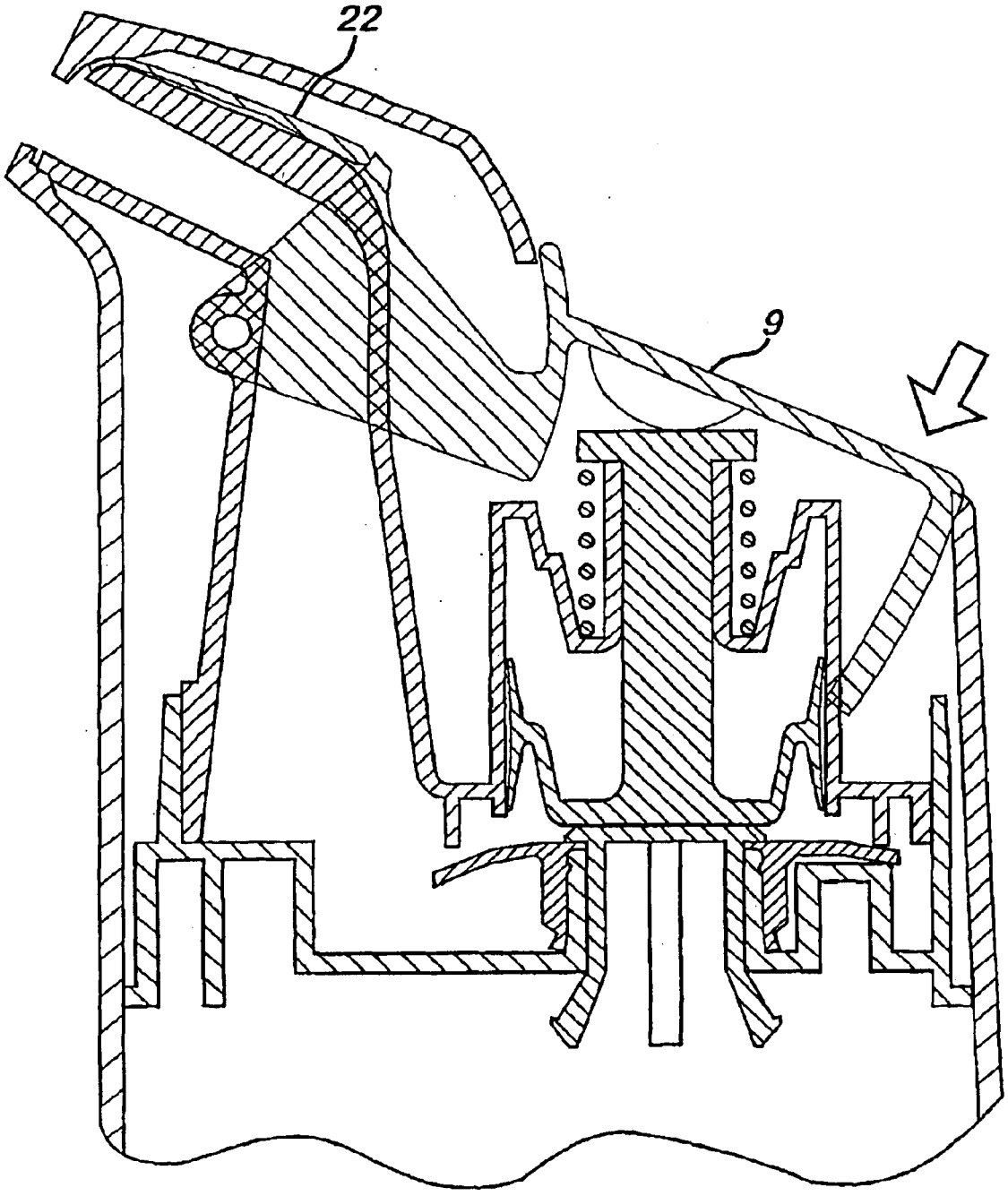

FIGS. 8 and 9 show a second embodiment which addresses this issue. Instead of a plunger cap, this embodiment uses an actuating lever 9 pivoted at the front of the dispenser. Here the pivot connection 91 is provided at the front of the discharge channel component 15. Connection of the actuating lever 9 to the pivot 91 is via a pair of opposed side pieces 92 to either side of the channel 15, which meet at a bridge connector 94 just above the channel 15 adjacent its rear bend 154. This bridge connector 94 is at the shortest accessible radius relative to the pivot 91. The flexible blocking strip 22 is joined at the front of this bridge portion 94, e.g. integrally by means of a "living hinge" moulded in plastic, and extends along the guide track and round the front bend 153 as in the previous embodiment. An important difference here however is that the proximal portion 229 of the strip 22 is substantially thickened so that it is less liable to buckling when pushed forward along the track. Because this portion does not need to pass around any significant bend of the track, this thickening does not increase the force required. Since it is not liable to buckling, the guide track need engage it only from beneath and this reduces friction. The guide track engages the outside of the flexible strip only at and adjacent the bend next to the front opening (as in the first embodiment). Here the strip 22 is thinner so as to flex readily around the bend.

Since the actuating lever must move in an arc it cannot be fixed with the piston. Rather, we provide a curved cam boss 95 on its undersurface which engages a flat top surface 236 of the piston stem. The pump is positioned upright to bring the cam engagement position substantially forward of the rear end of the actuating lever 9 and this provides mechanical advantage, i.e. reduced required user force, in operating the pump and in moving the closure tongue 22.

While not shown in this embodiment, it could of course be arranged for some lost motion in the coupling of the lever 9 and piston to provide an early opening of the nozzle, as in the first embodiment.

What is claimed is:

1. A dispenser pump having a pump chamber (4) whose volume is alterable in a pumping stroke by relative movement between a body (11, 12, 16) of the pump and a plunger (21, 23) which is reciprocable relative to the body by hand actuation;

an inlet (111) being provided for flowable material to enter the pump chamber (4) from a container to which the pump is adapted to be secured, and an outlet leading from the pump chamber (4) to a discharge passage which extends along a discharge nozzle to an external nozzle opening (121);

the pump comprising a blocking element arranged for guided movement transverse to the discharge passage at a blocking location, between a blocked position in which said blocking element blocks the discharge passage and an open position in which the discharge passage is open for flow of material; characterized in that the discharge nozzle includes a guide track construction leading around a bend to the blocking location;

an elongate flexible drive connector extends along the guide track, longitudinally slidable relative to said guide track a proximal part of the drive connector is connected to the pump's plunger so that movement of the plunger relative to the pump body drives movement of the drive connector along the guide track, and a distal part of the drive connector acts on the blocking element, whereby said relative movement of the plunger drives movement of the blocking element between the blocked and open positions.

2. A dispenser pump according to claim 1 in which the distal part of the drive connector is joined to or integral with the blocking element.

3. A dispenser pump according to claim 1 in which the drive connector has a strip form.

4. A dispenser pump according to claim 1 in which the blocking location is at or adjacent the external nozzle opening.

5. A dispenser pump according to claim 1 in which the guide track extends along the discharge nozzle to said bend which is in register with the blocking location.

6. A dispenser pump according to claim 1 in which the discharge nozzle extends transversely to the plunger axis.

7. A dispenser pump according to claim 1 in which the guide track guides on both the inside and outside of the bend so that both pushing and pulling of the drive connector around the bend are possible.

8. A dispenser pump according to claim 1 in which the drive connector and blocking element are provided together in one piece as a flexible plastics strip.

9. A toothpaste dispenser comprising a dispenser pump in accordance with claim 1.

* * * * *